US008887401B2

(12) United States Patent
Oxford et al.

(10) Patent No.: US 8,887,401 B2
(45) Date of Patent: Nov. 18, 2014

(54) ROTATING BLADE ASSEMBLY

(76) Inventors: Anthony J. Oxford, Las Vegas, NV (US); Sheila A. Oxford, Las Vegas, NV (US)

( * ) Notice: Subject to any disclaimer, the term of this patent is extended or adjusted under 35 U.S.C. 154(b) by 193 days.

(21) Appl. No.: 13/526,468

(22) Filed: Jun. 18, 2012

(65) Prior Publication Data

US 2013/0333219 A1 Dec. 19, 2013

(51) Int. Cl.

| | |
|---|---|
| ***B26B 19/44*** | (2006.01) |
| ***B26B 19/30*** | (2006.01) |
| ***B26B 11/00*** | (2006.01) |
| ***B26B 1/00*** | (2006.01) |
| ***B26B 3/00*** | (2006.01) |

(52) U.S. Cl.
USPC ..... 30/41.6; 30/46; 30/123.3

(58) Field of Classification Search
CPC ..... B26B 19/12; B26B 19/14; B26B 19/16; B26B 19/34; B26B 19/046; B26B 19/145; B26B 19/3853; B26B 21/22; B26B 21/24; B26B 21/30; B26B 21/34; B26B 21/165
USPC ..... 30/42, 41, 123.3, 303, 34.2, 46, 41.6
See application file for complete search history.

(56) References Cited

U.S. PATENT DOCUMENTS

| | | | | | |
|---|---|---|---|---|---|
| 1,519,504 | A | * | 12/1924 | Pando | 30/42 |
| 2,060,635 | A | * | 11/1936 | Parkin | 30/46 |
| 2,127,881 | A | * | 8/1938 | Morris | 30/32 |
| 2,269,359 | A | * | 1/1942 | Ericson et al. | 30/43.1 |
| 2,327,284 | A | * | 8/1943 | Nyhagen | 30/43.4 |
| 2,332,379 | A | * | 10/1943 | Harris | 30/43.4 |
| 2,362,666 | A | * | 11/1944 | Sarver | 30/41.5 |
| 2,565,062 | A | * | 8/1951 | Blanchard | 30/32 |
| 2,989,805 | A | * | 6/1961 | Bringewald | 30/40 |
| 3,430,341 | A | * | 3/1969 | Choate | 30/40 |
| 3,722,091 | A | * | 3/1973 | Gagnon | 30/40 |
| 4,228,586 | A | * | 10/1980 | Thierry | 30/41 |
| 4,633,585 | A | * | 1/1987 | Whitaker et al. | 30/41 |
| 4,733,468 | A | * | 3/1988 | Zadro | 30/34.05 |
| 4,916,814 | A | * | 4/1990 | Althaus | 30/40.2 |
| 5,022,154 | A | * | 6/1991 | Johnson | 30/34.2 |
| 5,678,311 | A | * | 10/1997 | Avidor | 30/34.2 |
| D388,540 | S | * | 12/1997 | Ramar | D28/45 |
| 5,933,960 | A | * | 8/1999 | Avidor | 30/34.2 |
| 6,499,218 | B2 | * | 12/2002 | Rocha | 30/41 |
| 7,007,390 | B2 | * | 3/2006 | Mislove | 30/41.5 |
| 7,043,842 | B1 | * | 5/2006 | Taylor et al. | 30/41.5 |
| 8,033,022 | B2 | * | 10/2011 | Ben-Ari | 30/43.4 |

(Continued)

*Primary Examiner* — Ghassem Alie
*Assistant Examiner* — Bharat C Patel
(74) *Attorney, Agent, or Firm* — Ariel S. Bentolila; Bay Area IP Group LLC

(57) ABSTRACT

A rotating blade assembly provides a multiplicity of rotating blades for shaving. The rotating blades engage a surface, and create a multiplier effect for an enhanced shave. Multiple rotating blades minimize contact between each blade and the skin to extend the life of the blades, and also funnel hair and shaving cream away from the surface. A pair of gear assemblies inside the blade housing rotatably engages to provide smooth rotation for the blades. Openings in the blade housing create a space for the blades to extend out of, an opening for water to pass through during cleaning and usage, and an opening for the hair and shaving cream to pass through. A shaft locks the gear assembly to prevent rotation for more precise shaving of side burns, mustaches, and goatees. A hollow handle with an opening at the end allows residue to pass through during cleaning and usage.

19 Claims, 5 Drawing Sheets

(56) References Cited

U.S. PATENT DOCUMENTS

2007/0220755 A1* 9/2007 Dror ..... 30/42
2007/0245564 A1* 10/2007 Yiu ..... 30/40
2008/0060202 A1* 3/2008 Oh ..... 30/43.6
2011/0283539 A1* 11/2011 Bryan ..... 30/40.2

* cited by examiner

ROTATING BLADE ASSEMBLY

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to a razor blade. More particularly, one or more embodiments of the invention relate to multiple rotating blades used to enhance shaving.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that shaving is the removal of hair, by using a razor or any other kind of bladed implement, to slice it down to the level of the skin. Shaving is most commonly practiced by men to remove their facial hair and by women to remove their leg and underarm hair.

Typically, a razor is a bladed tool primarily used in the removal of unwanted body hair through the act of shaving. Different types of razors include straight razors, disposable razors and electric razors. Straight razors consist of a blade sharpened on one edge. The blade can be made of either stainless steel, which is slower to hone and strop, and holds an edge longer, or high carbon steel, which hones and strops quickly, but has a less durable edge. The blade rotates on a pin through its tang between two protective pieces called scales. The blade is constantly in contact with the skin while being stroked across the skin.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
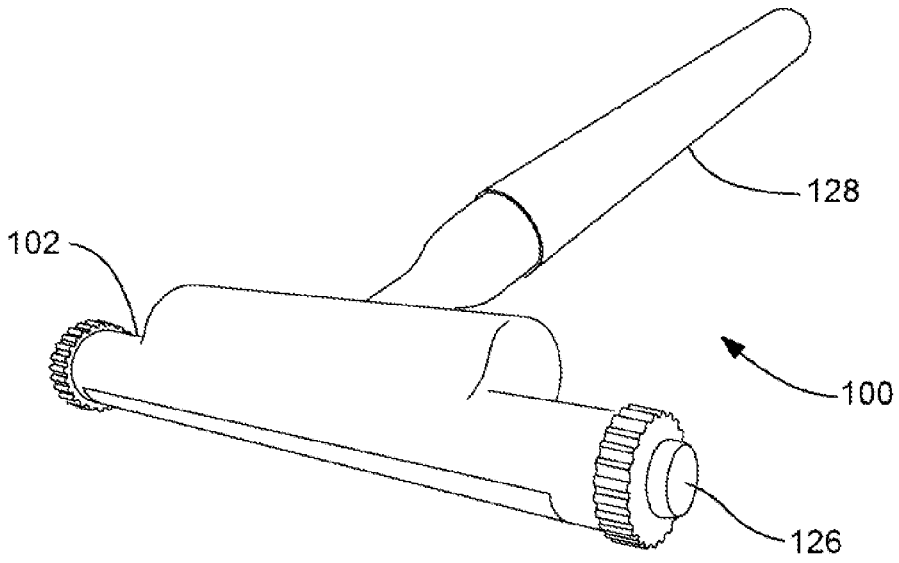
FIG. 1 illustrates an exemplary detailed perspective front top view of a rotating blade assembly, in accordance with an embodiment of the present invention.

Unless otherwise indicated illustrations in the figures are not necessarily drawn to scale.

DETAILED DESCRIPTION OF SOME EMBODIMENTS

Embodiments of the present invention are best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

The present invention will now be described in detail with reference to embodiments thereof as illustrated in the accompanying drawings.

There are various types of rotating blade assemblies 100 that may be provided by preferred embodiments of the present invention. For example, without limitation, the rotating blade assembly may provide a multiplicity of rotating blades to enhance shaving and remove shaving residue from a surface 138. In some embodiments, a multiplicity of blades 112 may be applied upon the desired surface location, offering multiple applications without requiring multiple strokes. In some embodiments, as the rotating blade assembly is pulled along the surface, the effect of multiple blades engaging the surface may create a multiplier effect on the surface for an enhanced removal of the residue. In some embodiments, the rotating effect of the multiplicity of blades upon the residue, including, without limitation, hair, shaving cream, and water, may provide for a cleaner shave with less risk of cuts, nicks and irritation. In some embodiments, the surface may include without limitation, a face, a leg, a neck, and the like. The rotating blade assembly may include a blade housing 102 that contains the multiplicity of blades. The blades may be positioned and extend from the outer perimeter of a rotating cylinder portion 106. A blade proximal end 114 joins with the cylinder portion. A blade distal end 116 located on one end of each blade may include a sharp surface 118 for cutting the multiplicity of residue from the surface. In some embodiments, at least one blade aperture 104 may be located in numerous areas of the blade housing. Each blade aperture may provide various functions, including, without limitation, an aperture for the multiplicity of blades to extend from, an aperture to pass water through for cleaning, and an aperture for a multiplicity of residue 136 to pass through the blade housing. At least one gear assembly 120 inside the blade housing rotatably engages at least one cylinder portion gear assembly to provide smooth rotation for the blades. Those skilled in the art, in light of the present teachings, will recognize that the gears acting in conjunction may create a frictional effect on the rotating blades to provide a more consistent blade rotation. In some embodiments, at least one shaft 124 may engage the at least one gear assembly to lock the rotating mechanism. In some embodiments, locking the rotation facilitates shaving of facial hair that requires greater precision when shaving, including, without limitations, side burns, mustaches, and goatees. At least one protruding member 126 may extend and retract the shaft between a multiplicity of gear teeth 122 that extend from each gear assembly. The protruding member is also detachable for providing access to at least one blade aperture 104. In some embodiments, a fluid, including, without limitation, water may be passed through the blade aperture for cleaning the blades and the inside of the blade housing. In some embodiments, a handle portion 128 may extend from the blade housing and may be operable to grip the rotating blade assembly. The handle portion may include a handle hollow portion 130 and a handle aperture 132 to allow the residue, including, without limitation, water, hair, and shaving cream to pass from the blade housing through the handle hollow portion, and out the handle aperture.

FIG. 1 illustrates an exemplary detailed perspective front top view of a rotating blade assembly, in accordance with an embodiment of the present invention. In some embodiments, the rotating blade assembly may include the blade housing for retaining the functional components of the present invention. Suitable materials for fabricating the blade housing may include, without limitation, polystyrene, polyvinyl chloride, plastic, metal, and silicone. In some embodiments, the blade housing may be dimensioned and shaped to include, without limitation, a semi-cylindrical head measuring 1½" in length and with a ¾" maximum height. However, other sizes may be utilized in other embodiments. In some embodiments, the blade housing may include at least one blade aperture configured to expose a different portion of the blade distal end for each of the multiplicity of positions to which the blade distal end is rotatable. The blade aperture may be dimensioned and shaped to include, without limitation, a 1"×¼" aperture in a rear arc of the blade housing. However, other sizes may be utilized in other embodiments. Those skilled in the art, in light of the present teachings, will recognize that the at least one blade aperture may also allow the multiplicity of residue to pass outside the blade housing.

Figure 2:
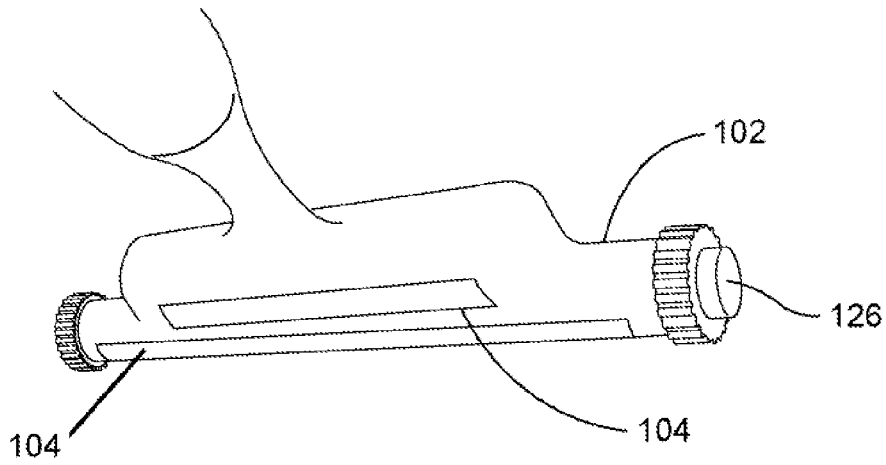
FIG. 2 illustrates an exemplary detailed perspective rear bottom view of the blade housing, in accordance with an embodiment of the present invention.

FIG. 2 illustrates an exemplary detailed perspective rear bottom view of the blade housing, in accordance with an embodiment of the present invention. In some embodiments, the rotating blade assembly may include the multiplicity of blades extending from the blade housing. In some embodiments, the blades may extend beyond the at least one blade aperture sufficiently to provide a close shave, including, without limitation, twelve titanium blades measuring 1½"×⅙", and positioned at 35° angles. However, other sizes and angles may be utilized in other embodiments. Those skilled in the art, in light of the present teachings, will recognize that utilizing twelve blades minimizes contact for each individual blade so that the life of the blade is extended. The 35° angle at which the blades are positioned may also maximize cutting capacity and provide a funneling effect to funnel the multiplicity of residue from the surface, through the blade aperture. The angle at which the blade housing is positioned onto the surface may also enhance the shaving. In one alternative embodiment, the 35° angle of the multiplicity of blades may be adjusted wider or narrower to compensate for different surface textures and angles.

Figure 3:
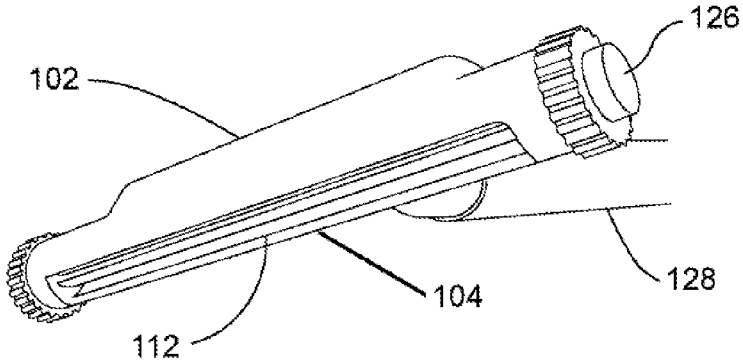
FIG. 3 illustrates an exemplary detailed perspective front view of the blade housing, in accordance with an embodiment of the present invention.

FIG. 3 illustrates an exemplary detailed perspective front view of the blade housing, in accordance with an embodiment of the present invention. In some embodiments, the ends of the blade housing may include at least one protruding member that engages the shaft to extend and retract the shaft between the multiplicity of gear teeth. In some embodiments, two protruding members may extend from the sides of the blade housing. In some embodiments, the protruding members detach to providing access to a blade aperture located on each side of the blade housing. In some embodiments, a fluid, including, without limitation, water may be passed through the exposed blade apertures for cleaning the multiplicity of blades and the inside of the blade housing. Suitable materials for fabricating the at least one protruding member may include, without limitation, polystyrene, polyvinyl chloride, plastic, rubber, metal, and silicone.

Figure 4A:
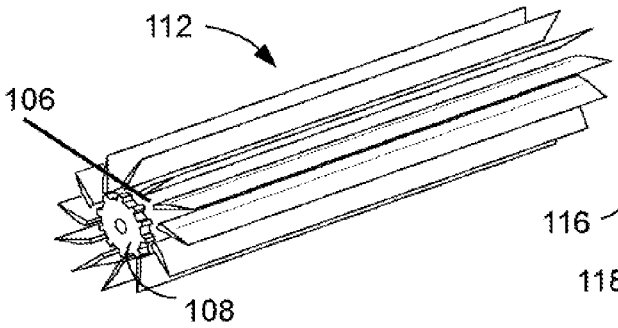
FIGS. 4A and 4B illustrate exemplary views of a multiplicity of blades, in accordance with an embodiment of the present invention.
Figure 4B:
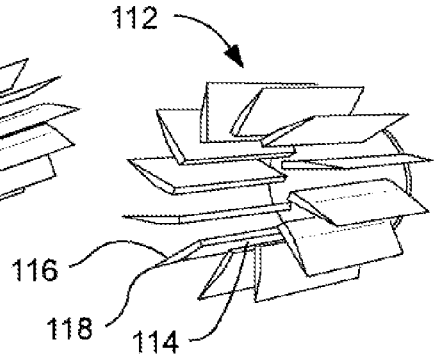

FIGS. 4A and 4B illustrate exemplary views of a multiplicity of blades, in accordance with an embodiment of the present invention. FIG. 4A illustrates an exemplary cylinder portion 106 having the multiplicity of blades attached around the outer perimeter. The cylinder portion rotates about an axis within the blade housing. Those skilled in the art, in light of the present teachings, will recognize that the cylinder portion may rotate at an angular velocity sufficient for shaving a face, and dependent on the rate at which a user strokes the rotating blade assembly along the surface. The cylinder portion may be sized and dimensioned with an approximate 1½" length by ¾" diameter. However, other sizes may be utilized in other embodiments. In some embodiments, the cylinder portion may include at least one cylinder portion gear assembly 108. Each cylinder portion gear assembly may be positioned at opposite ends of the cylinder portion and include a multiplicity of cylinder portion teeth 110 operable to rotatably engage adjacent teeth from another gear assembly and generate rotation. In some embodiments, the multiplicity of cylinder portion teeth includes periodic ⅛" indentations for meshing against a similarly dimensioned set of gear teeth, and creating rotation. FIG. 4B illustrates an exemplary illustration of the multiplicity of blades separated from the cylinder portion. In some embodiments, each blade may act to cut hair and to funnel the multiplicity of hair and shaving cream from the blade housing through the at least one blade aperture. Suitable materials for fabricating the multiplicity of blades may include, without limitation, titanium, stainless steel, high carbon steel, and honed steel. In some embodiments, each blade may include a blade proximal end 114 that joins with the outer perimeter of the cylinder portion. In some embodiments, the blade proximal end may join the cylinder housing at a desired angle, including, without limitation a 35° angle efficacious for cutting hair. In some embodiments, each blade may include the distal end, which may terminate into a sharp surface. In some embodiments, the sharp surface is a titanium edge sufficiently sharp for cutting hair. Those skilled in the art, in light of the present teachings, will recognize that the complete rotation of the multiplicity of blades about the cylinder portion may provide as much as three times more blade contact than a standard, planar blade assembly would provide in the same stroke length. Each rotating blade may also have a longer life due to less contact time with the surface. In some embodiments, the multiplicity of blades may be detachable and replaced.

Figure 5:
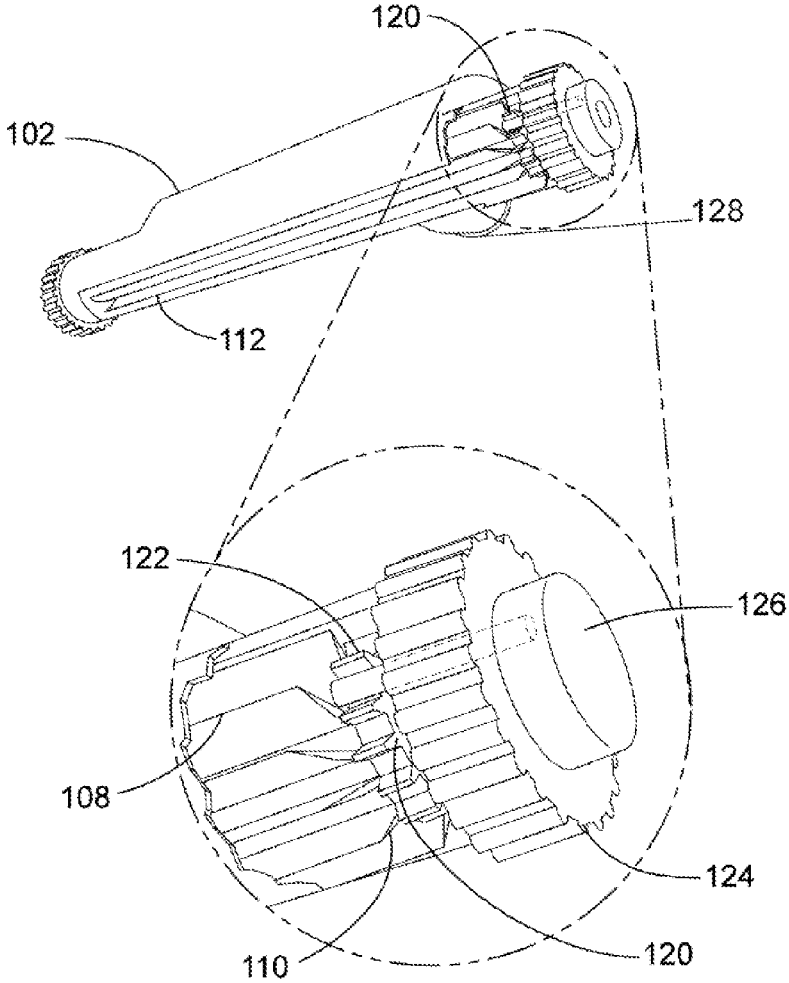
FIG. 5 illustrates an exemplary blow up view of the at least one gear assembly engaging the at least one cylinder portion gear assembly and the shaft, in accordance with an embodiment of the present invention.

FIG. 5 illustrates an exemplary blow up view of the at least one gear assembly engaging the at least one cylinder portion gear assembly and the shaft, in accordance with an embodiment of the present invention. In some embodiments, each gear assembly positions on opposite ends of the blade housing, and rests adjacent and outside of each cylinder portion gear assembly. In some embodiments, the multiplicity of gear teeth may rotatably mesh against the multiplicity of cylinder portion teeth to rotate. In some embodiments, the at least one gear assembly may rotate counter to the at least one cylinder portion gear assembly. In some embodiments, the shaft may engage the at least one gear assembly to lock the rotating mechanism. The shaft may lodge between the multiplicity of gear teeth, acting as a physical barrier to prevent rotation. The locking effect may facilitate shaving of facial hair that requires greater precision when shaving, including, without limitations, side burns, mustaches, and goatees. Each protruding member may extend and retract the shaft between the multiplicity of gear teeth. In one alternative embodiment, the shaft may inhibit rotation by engaging the at least one cylinder portion gear assembly or the cylinder portion.

Figure 6:
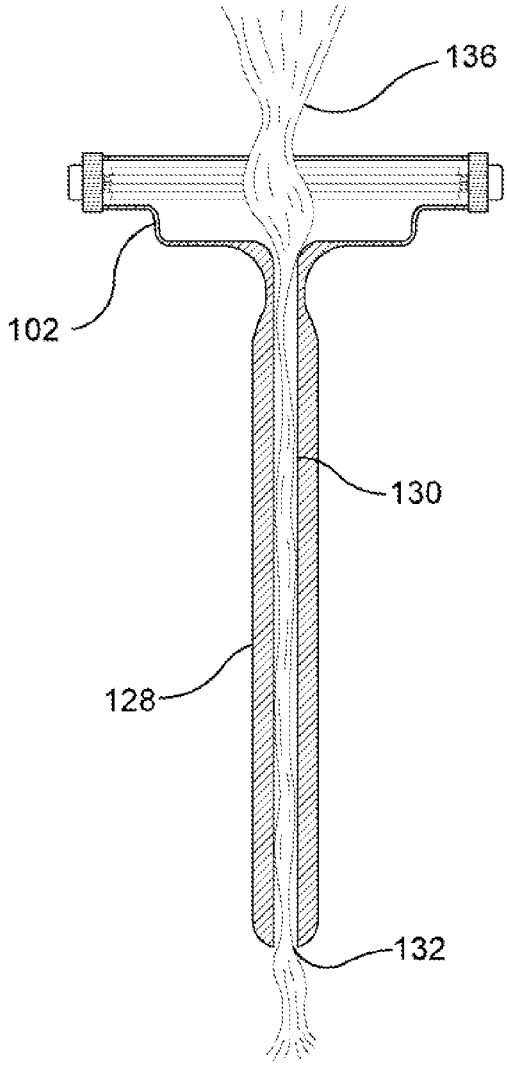
FIG. 6 illustrates an exemplary elevated frontal view of the rotating blade assembly with residue passing through a handle hollow portion and a handle aperture, in accordance with an embodiment of the present invention.

FIG. 6 illustrates an exemplary elevated frontal view of the rotating blade assembly with residue passing through a handle hollow portion and a handle aperture, in accordance with an embodiment of the present invention. In some embodiments, the handle portion extends from the blade housing to provide a grasping point to maneuver the rotating blade assembly. Suitable materials for fabricating the handle portion may include, without limitation, polystyrene, polyvinyl chloride, plastic, rubber, metal, and silicone. In some embodiments, the handle portion may provide a conduit for cleaning the rotating blade assembly after usage. In some embodiments, the residue that forms inside the rotating blade assembly may be cleaned by detaching each protruding member and passing a fluid, including, without limitation, water, over the blade housing. In some embodiments, the fluid may pass through each blade aperture, and through the handle hollow portion. The fluid and residue may finally pass through the handle aperture. In some embodiments, the handle portion may include a textured surface 134 for providing an enhanced grip.

Figure 7:
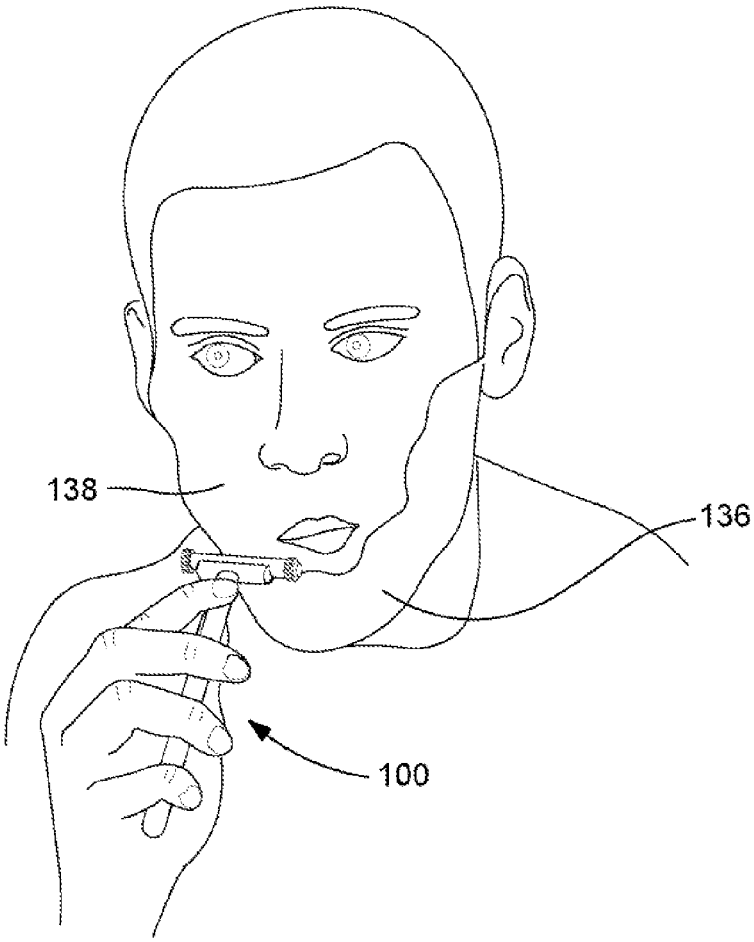
FIG. 7 illustrates an exemplary rotating blade assembly removing residue from a surface, in accordance with an embodiment of the present invention.

FIG. 7 illustrates an exemplary rotating blade assembly removing residue from a surface, in accordance with an embodiment of the present invention. In some embodiments, the rotating blade assembly may be utilized for shaving a face. In some embodiments the rotating blade assembly may be utilized by both males and females for a multiplicity of body parts. Those skilled in the art, in light of the present teachings, will recognize that the rotating blade assembly may shave the face without rotation, especially when more precise control is desired. In some embodiments, the multiplicity of blades may be applied upon the desired location, offering multiple applications upon the residue without requiring multiple strokes.

All the features or embodiment components disclosed in this specification, including any accompanying abstract and drawings, unless expressly stated otherwise, may be replaced by alternative features or components serving the same, equivalent or similar purpose as known by those skilled in the art to achieve the same, equivalent, suitable, or similar results by such alternative feature(s) or component(s) providing a similar function by virtue of their having known suitable properties for the intended purpose. Thus, unless expressly stated otherwise, each feature disclosed is one example only of a generic series of equivalent, or suitable, or similar features known or knowable to those skilled in the art without requiring undue experimentation.

Having fully described at least one embodiment of the present invention, other equivalent or alternative methods of implementing a multiplicity of rotating blades for enhanced cutting on a surface according to the present invention will be apparent to those skilled in the art. Various aspects of the invention have been described above by way of illustration, and the specific embodiments disclosed are not intended to limit the invention to the particular forms disclosed. The particular implementation of the multiplicity of rotating blades for enhanced cutting on a surface may vary depending upon the particular context or application. By way of example, and not limitation, the multiplicity of rotating blades for enhanced cutting on a surface described in the foregoing were principally directed to shaving portions of the body implementations; however, similar techniques may instead be applied to horticultural trimming functions, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. A rotating blade assembly comprising:

a blade housing, said blade housing comprising at least one blade aperture;

a cylinder portion, said cylinder portion operable to rotate about an axis within said blade housing, said cylinder portion comprising at least one cylinder portion gear assembly, said at least one cylinder portion gear assembly comprising a multiplicity of cylinder portion teeth;

a multiplicity of blades, said multiplicity of blades being joined to an outer circumference of said cylinder portion, said multiplicity of blades comprising a blade proximal end, said blade proximal end being joined to said cylinder portion, said multiplicity of blades further comprising a blade distal end, said blade distal end being configured to extend past said at least one blade aperture, said blade distal end being operable to rotate about said cylinder portion;

at least one gear assembly, said at least one gear assembly being operable to rotate about an axis adjacent to said axis of said cylinder portion, said at least one gear assembly comprising a multiplicity of gear teeth, said multiplicity of gear teeth being operable to rotatably engage with said multiplicity of cylinder portion teeth;

at least one shaft, said at least one shaft being operable to extend between and retract from said multiplicity of gear teeth;

at least one protruding member, said at least one protruding member joined to said blade housing, said at least one protruding member being configured to engage said at least one shaft; and a handle portion, said handle portion comprising a handle hollow portion, said handle portion further comprising at least one handle aperture, said handle portion being joined to said blade housing.

2. The rotating blade assembly of claim 1, wherein said multiplicity of blades is rotatable to a plurality of positions within said blade housing.

3. The rotating blade assembly of claim 2, wherein said blade aperture is configured to expose a different portion of said blade distal end for each of the multiplicity of positions to which said blade distal end is rotatable.

4. The rotating blade assembly of claim 3, wherein said blade distal end rotatably engages a surface.

5. The rotating blade assembly of claim 4, wherein said at least one gear assembly rotates counter to said cylinder portion gear assembly.

6. The rotating blade assembly of claim 5, wherein said shaft inhibits rotation of said cylinder portion when extended between said multiplicity of cylinder portion teeth.

7. The rotating blade assembly of claim 6, wherein said at least one protruding member is operable to extend said at least one shaft between said multiplicity of gear teeth for inhibiting rotation of said cylinder portion.

8. The rotating blade assembly of claim 7, wherein said at least one protruding member is operable to retract said at least one shaft from said multiplicity of gear teeth for allowing rotation of said cylinder portion.

9. The rotating blade assembly of claim 8, wherein said at least one protruding member is detachable to expose said at least one blade aperture.

10. The rotating blade assembly of claim 9, wherein said at least one protruding member detaches to allow the inside of said blade housing to be cleaned.

11. The rotating blade assembly of claim 10, in which said blade distal end comprises a sharp surface.

12. The rotating blade assembly of claim 11, wherein said sharp surface is operable to remove a multiplicity of residue from said surface.

13. The rotating blade assembly of claim 12, wherein said multiplicity of residue engages said multiplicity of blades and passes through said at least one blade aperture.

14. The rotating blade assembly of claim 13, wherein said multiplicity of residue passes through said handle hollow portion.

15. The rotating blade assembly of claim 14, wherein said multiplicity of residue passes through said at least one handle aperture.

16. The rotating blade assembly of claim 15, in which said handle portion comprises a textured surface for providing enhanced grip.

17. The rotating blade assembly of claim 16, in which said multiplicity of residue comprises hair, water, and shaving cream.

18. The rotating blade assembly of claim 17, in which said multiplicity of blades comprises at least twelve blades.

19. A rotating blade assembly consisting of:

a blade housing, said blade housing comprising at least one blade aperture, said at least one blade aperture being configured to expose a different portion of a blade distal end for each of the multiplicity of positions to which said blade distal end is rotatable;

a cylinder portion, said cylinder portion operable to rotate about an axis within said blade housing, said cylinder portion comprising at least one cylinder portion gear assembly, said at least one cylinder portion gear assembly comprising a multiplicity of cylinder portion teeth;

a multiplicity of blades, said multiplicity of blades being joined to an outer circumference of said cylinder portion, said multiplicity of blades comprising a blade proximal end, said blade proximal end being joined to said cylinder portion, said multiplicity of blades further comprising said blade distal end, said blade distal end being configured to extend past said at least one blade aperture, said blade distal end being operable to rotate about said cylinder portion, said blade distal end being further operable to rotatably engage a surface, said blade distal end comprising a sharp surface;

at least one gear assembly, said at least one gear assembly being operable to rotate about an axis adjacent to said axis of said cylinder portion, said at least one gear assembly comprising a multiplicity of gear teeth, said multiplicity of gear teeth being operable to rotatably engage with said multiplicity of cylinder portion teeth;

at least one shaft, said at least one shaft being operable to extend between and retract from said multiplicity of gear teeth, said at least one shaft said shaft being operable to inhibit rotation of said cylinder portion when extended between said multiplicity of cylinder portion teeth;

at least one protruding member, said at least one protruding member joined to said blade housing, said at least one protruding member being configured to engage said at least one shaft, said at least one protruding member being detachable; and a handle portion, said handle portion comprising a handle hollow portion, said handle portion further comprising at least one handle aperture, said handle portion further comprising a textured surface, said handle portion being joined to said blade housing.

* * * * *